US008062078B2

(12) United States Patent
Asai et al.

(10) Patent No.: US 8,062,078 B2
(45) Date of Patent: Nov. 22, 2011

(54) PRESS-CONTACT POGO PIN CONNECTOR

(75) Inventors: Kiyoshi Asai, Tokyo (JP); Manabu Dobashi, Tokyo (JP)

(73) Assignee: SMK Corporation, Tokyo (JP)

( * ) Notice: Subject to any disclaimer, the term of this patent is extended or adjusted under 35 U.S.C. 154(b) by 0 days.

(21) Appl. No.: 12/869,258

(22) Filed: Aug. 26, 2010

(65) Prior Publication Data

US 2011/0104959 A1 May 5, 2011

(30) Foreign Application Priority Data

Nov. 2, 2009 (JP) ..... 2009-252174

(51) Int. Cl.
*H01R 4/52* (2006.01)

(52) U.S. Cl. ..... 439/823; 439/482; 439/700

(58) Field of Classification Search ..... 439/823, 439/700, 824, 482, 658
See application file for complete search history.

(56) References Cited

U.S. PATENT DOCUMENTS

| | | | | |
|---|---|---|---|---|
| 6,083,059 | A * | 7/2000 | Kuan | 439/862 |
| 7,094,112 | B2 * | 8/2006 | Arai et al. | 439/700 |
| 7,527,532 | B2 * | 5/2009 | Northey | 439/700 |
| 7,611,389 | B2 * | 11/2009 | Toivanen et al. | 439/700 |
| 7,815,474 | B1 * | 10/2010 | Lin et al. | 439/700 |

FOREIGN PATENT DOCUMENTS

WO 2005/112200 11/2005

* cited by examiner

*Primary Examiner* — Hae Moon Hyeon
(74) *Attorney, Agent, or Firm* — Edwards Angell Palmer & Dodge LLP; Peter C. Schechter; Brian R. Landry

(57) ABSTRACT

A press-contact pogo pin connector is provided which has a machining cost lower than those of conventional connectors, can be easily reduced in height, and does not cause instantaneous interruption. A molded insulating housing has a cylinder hole. A pin installed inside the cylinder hole is urged by a coil spring installed inside the cylinder hole so as to protrude from the housing. A flange portion on the rear side of the pin urged by the coil spring abuts against the peripheral portion of the front opening of the cylinder hole on the front side of the housing so that the pin is prevented from falling off. A contact integrally includes a substrate connection terminal portion and a contact spring portion that extends inside the cylinder hole and is brought into press-contact with the pin at all times. The contact is secured to the housing.

2 Claims, 12 Drawing Sheets

FIGURE 5 (a)
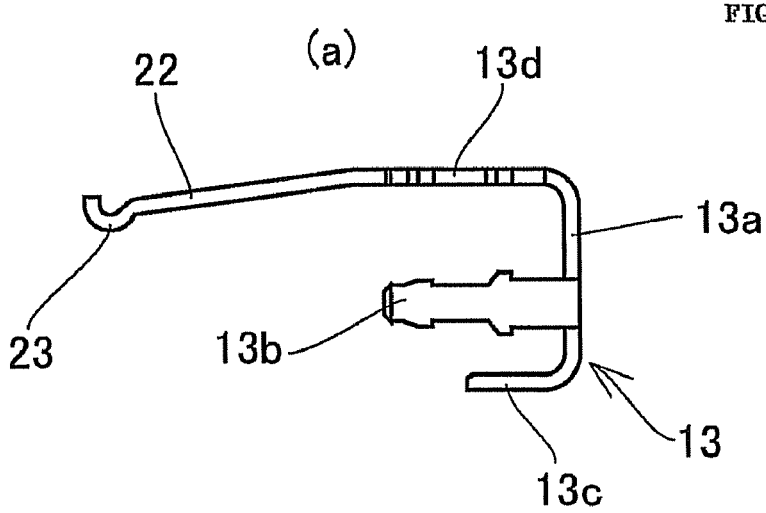
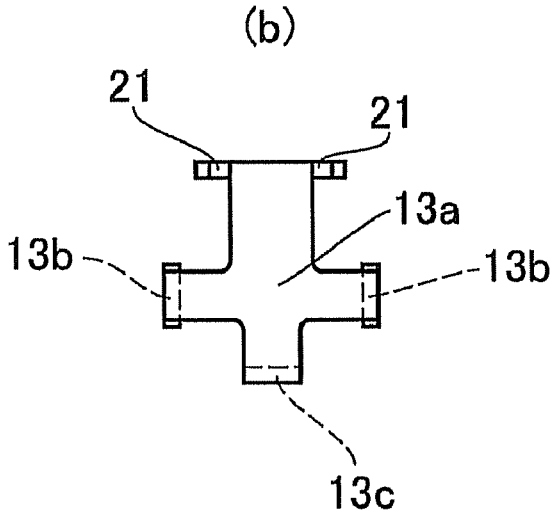
FIGURE 5 (b)
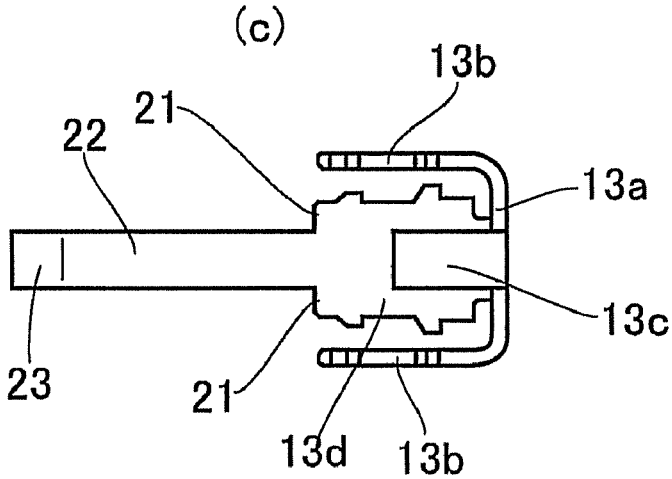
FIGURE 5 (c)

PRESS-CONTACT POGO PIN CONNECTOR

BACKGROUND OF THE INVENTION

1. Field of the Invention

The present invention relates to a press-contact pogo pin connector used mainly as a battery connector for small electronic devices such as mobile phones.

2. Description of the Related Art

Press-contact connectors with pogo pins are conventionally used as battery connectors for mobile phones.

As show in FIG. 11, in conventional pogo pins used for such press-contact connectors, a pin 3 urged in its protruding direction by a coil spring 2 is movably installed inside a metal-made closed-end cylinder 1 with the end of a press-contact pin 3*a* of the pin 3 protruding from the end of the cylinder 1. The press-contact pin 3*a* is to be brought into press-contact with a contact terminal of a battery by the urging force of the coil spring 2 in the protruding direction.

A bias cut surface 4 inclined with respect to the axial direction is formed on the cylinder-side inner end surface of the pin 3. The coil spring 2 pushes the bias cut surface 4, and a force component perpendicular to the pushing direction is thereby generated. This force component causes the circumferential surface of the pin 3 to be in press-contact with the inner surface of the cylinder 1 at all times, and this allows electric current to flow from the pin 3 through the cylinder 1.

In a press-contact connector with such pogo pins, the cylinder and the pins are produced using various machining devices such as a lathe, milling machine, and press. Therefore, the manufacturing cost is high, and a reduction in size is limited due to mechanical machining. Another problem is that, since the cylinder is installed inside a molded housing, the overall height of the connector cannot be small. Still another problem is that, since the connector is configured such that the pin 3 can radially move within the cylinder 1, an instantaneous interruption can easily occur when an external shock is applied.

To reduce the machining cost and to improve the resistance to instantaneous interruption, a press-contact connector shown in FIG. 12 has been developed (for example, WO2005/112200). In this connector, a pin 3 and a cylinder 1 that receives the pin 3 are produced by stamping and bending a metal plate, and the electrical continuity between the cylinder 1 and the pin 3 is ensured by allowing an elastic contact member 5 projecting along the inner surface of the cylinder 1 to come in press-contact with the external circumferential surface of the pin 3 at all times.

In the connector having a cylinder and a pin formed by bending a plate as shown in FIG. 12, the machining cost is reduced, and the resistance to external shock is improved. However, both the cylinder used as an outer cylinder and the pin used as an inner cylinder are produced by machining metal members and are incorporated in a molded housing. Therefore, the problem with this press-contact connector is that its height does not satisfactorily meet the low profile requirement when the connector is mounted in a direction parallel to a substrate.

SUMMARY OF THE INVENTION

The present invention has been made in view of the foregoing problems in the conventional technology, and it is an object of the invention to provide a press-contact pogo pin connector having a machining cost lower than those of conventional connectors, can be easily reduced in height, and does not cause instantaneous interruption.

To solve the above problems and to achieve the above object, a first aspect of the present invention provides a press-contact pogo pin connector comprising: a molded insulating housing having a cylinder hole for allowing a pin to be installed therein, with a front opening of the cylinder hole provided on a front side of the housing; a pin that includes a flange portion at a rear end thereof and is installed inside the cylinder hole; a coil spring that is installed inside the cylinder hole and urges the pin so that the pin protrudes from the housing; and a contact that includes a substrate connection terminal portion and a contact spring portion and is secured to the housing, the substrate connection terminal portion and the contact spring portion being integrally provided, the contact spring portion extending inside the cylinder hole and being brought into press-contact with the pin at all times, wherein the flange portion of the pin urged by the coil spring abuts against a peripheral portion of the front opening of the cylinder hole so that the pin is prevented from falling off.

In a second aspect of the invention according to the first aspect, the pin includes a metal rod-shaped main pin body and the flange portion that is formed integrally with a rear outer circumference of the main pin body so as to protrude therefrom.

In a third aspect of the invention according to the first aspect, the pin includes a main pin body formed by bending a metal strip into a U-shape with two parallel portions and the flange portion that is integrally formed on each side end edge of each of the two parallel portions so as to protrude therefrom.

In a fourth aspect of the invention according to the third aspect, the main pin body includes a spring receiving portion formed by bending an end portion of one of the two parallel portions that form the U-shape toward the other parallel portion, and an end of the coil spring abuts against the spring receiving portion.

In the present invention, the molded insulating housing has the cylinder hole in which the pin is installed, and the pin installed inside the cylinder hole is urged by the coil spring installed inside the cylinder hole so as to protrude from the housing. The flange portion on the rear side of the pin urged by the coil spring abuts against the peripheral portion of the front opening of the cylinder hole on the front side of the housing so that the pin is prevented from falling off. In this configuration, the housing itself has a cylinder function. Therefore, the press-contact pogo pin connector according to the present invention can be reduced in size as compared to a conventional press-contact pogo pin connector including a metal cylinder incorporated in a housing.

In addition, the amount of the metal material used is reduced, so that the material cost can be reduced. With the above configuration, the number of pins can be easily increased, and press-contact connectors having various shapes can be provided by changing the shapes of their housings.

The pin and the substrate connection terminal portion are electrically connected by securing to the housing the contact integrally including the substrate connection terminal portion and the contact spring portion that extends inside the cylinder hole and is brought into press-contact with the pin at all times. In this manner, a stable continuity state can be achieved using a simple structure.

In the present invention, the flange portion of the pin may be formed integrally with the rear outer circumference of a metal rod-shaped main pin body. In this configuration, the rear end bias cut that must be provided in a conventional pin is not required. Therefore, pins mass-produced using a conventional facility can be utilized, so that the capital investment can be reduced.

In the present invention, the main pin body of the pin may be formed by bending a metal strip into a U-shape with two parallel portions, and the flange portion may be integrally formed so as to extend from each side end edge of each of the parallel portions. With this configuration, the pin can be produced by press working of a plate material, so that the manufacturing cost can be reduced.

In the present invention, the main pin body may include a spring receiving portion formed by bending the end portion of one of the two parallel portions that form the U-shape toward the other parallel portion, and the end of the coil spring may abut against the spring receiving portion. With this configuration, the length of the coil spring can be reduced.

BRIEF DESCRIPTION OF THE DRAWINGS

FIG. 5A is a side view of a contact used in the first embodiment, FIG. 5B is a rear view thereof, FIG. 5C is a bottom view thereof;

DETAILED DESCRIPTION OF THE PREFERRED EMBODIMENTS

Figure 1:
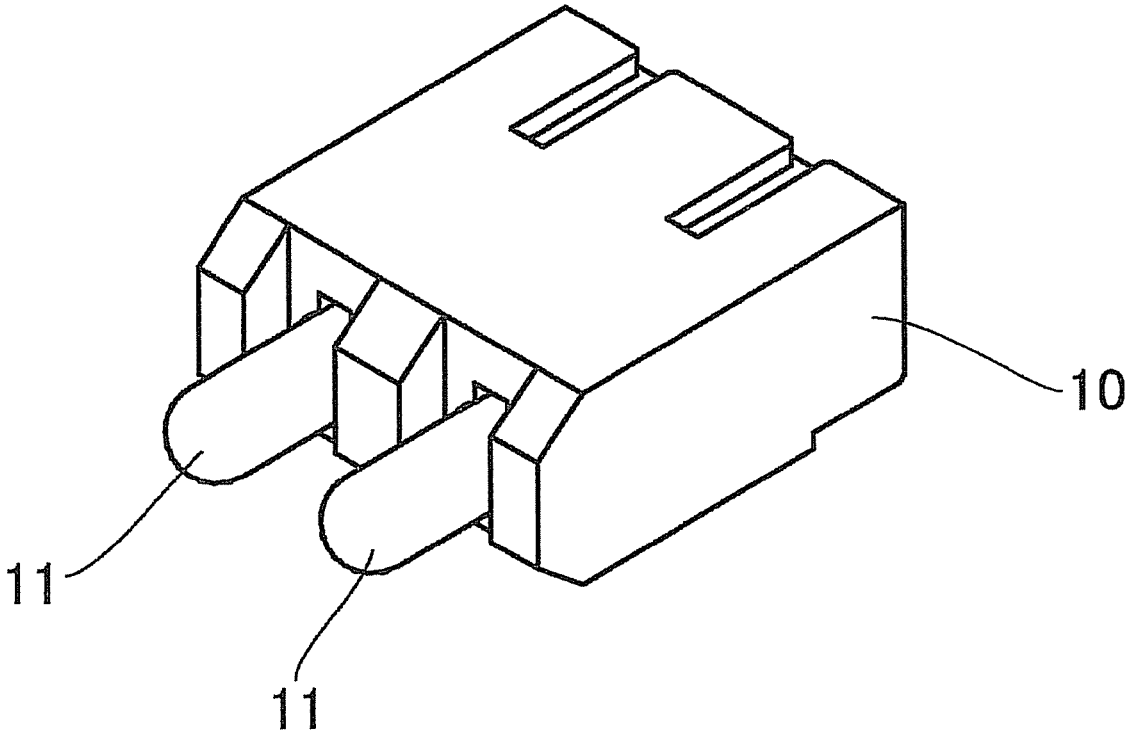
FIG. 1 is a front perspective view illustrating the appearance of a first embodiment of a press-contact pogo pin connector according to the present invention.

Next, preferred embodiments of the present invention will be described with reference to the drawings.

FIGS. 1 to 5C show a first exemplary embodiment of a press-contact pogo pin connector according to the present invention. In the first embodiment, a plurality of elastically protruding pogo pins (in the shown example, two (2) pins) are used in a battery connector. This press-contact pogo pin connector is composed of a housing 10, the pins 11, coil springs 12, and contacts 13. The pair of pins 11 are movably installed in the housing 10.

The housing 10 is molded of an insulating synthetic resin material and has a pair of cylinder holes 20 having openings on their front and rear ends. Each cylinder hole 20 has a circular front opening 20*a* that is provided on the front side of the housing. However, a main portion 20*b* of the cylinder hole 20 that is provided on the rear side of the housing and extends from the front opening 20*a* toward the contact 13 is formed to have a non-circular shape so that a flange portion 11*b* (described later) at the rear end of the pin 11 is unrotatably fitted into the main portion 20*b*.

Figure 4:
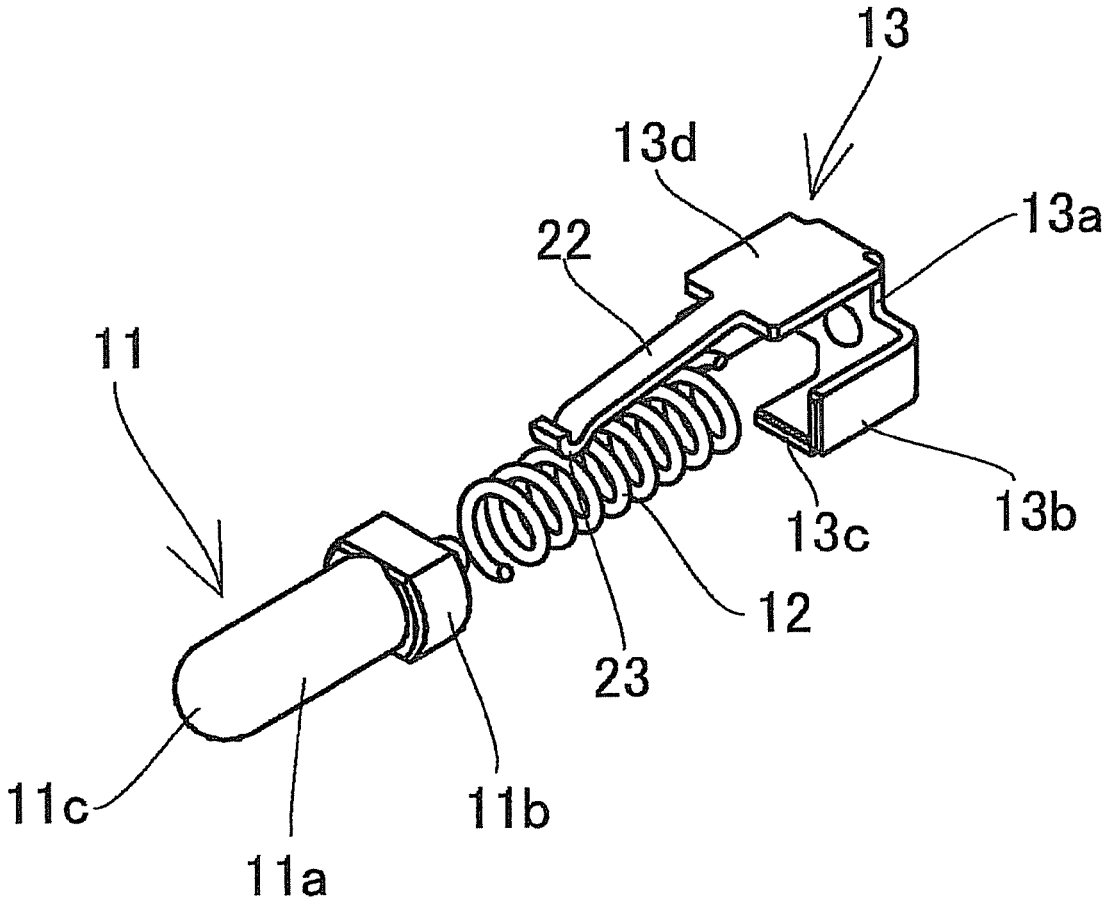
FIG. 4 is an exploded perspective view illustrating a pin, a coil spring, and a contact of the press-contact pogo pin connector in the first embodiment.
Figure 6:
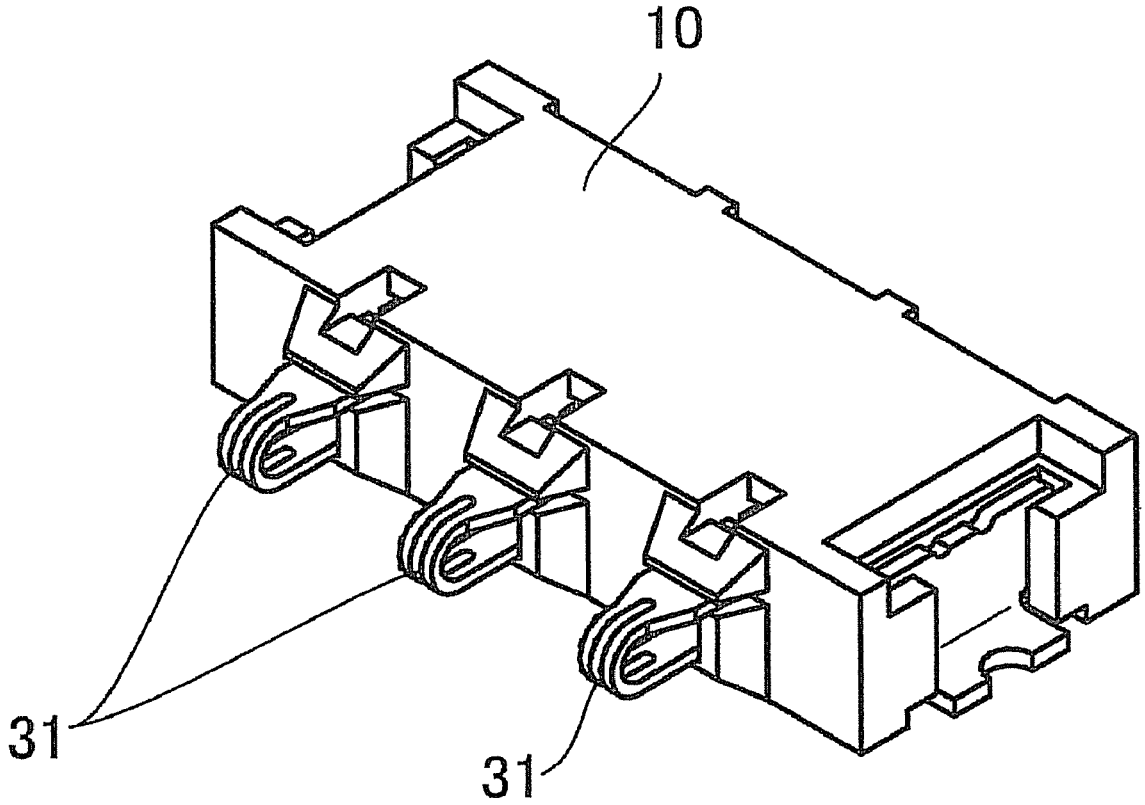
FIG. 6 is a front perspective view illustrating the appearance of a second embodiment of the press-contact pogo pin connector according to the present invention.
Figure 7:
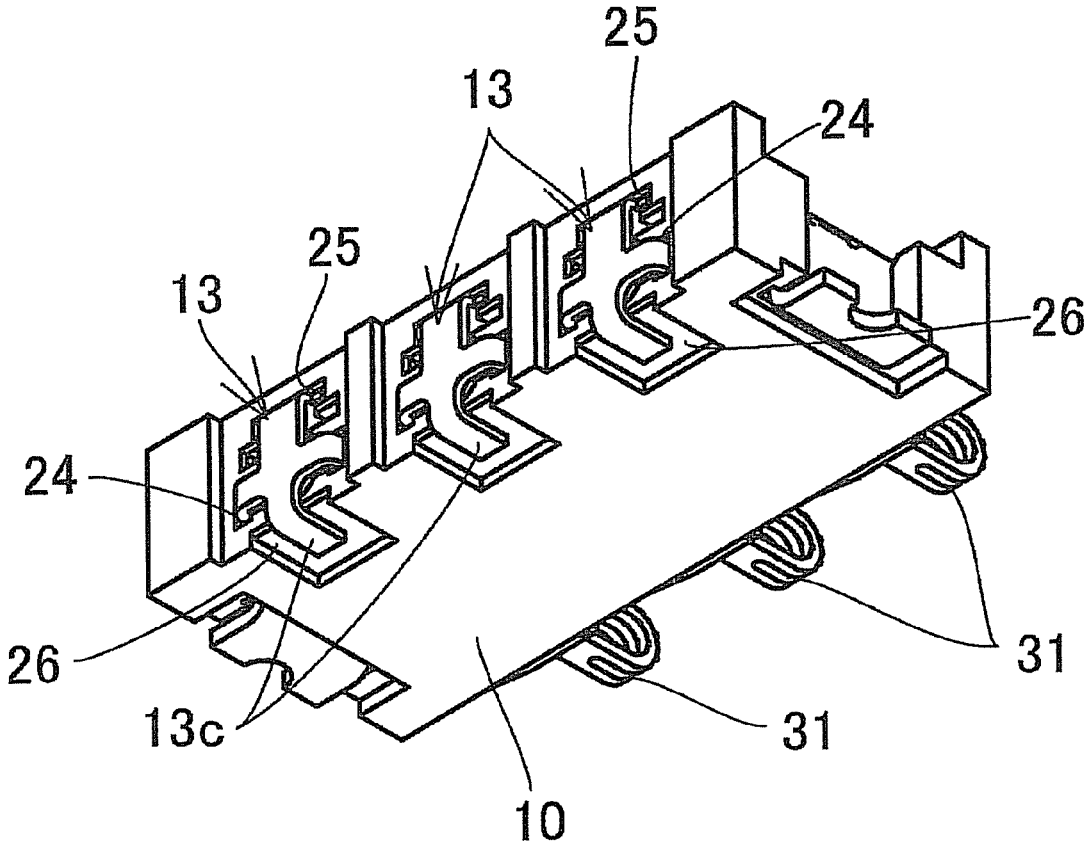
FIG. 7 is a rear perspective view of the press-contact pogo pin connector in the second embodiment.
Figure 8:
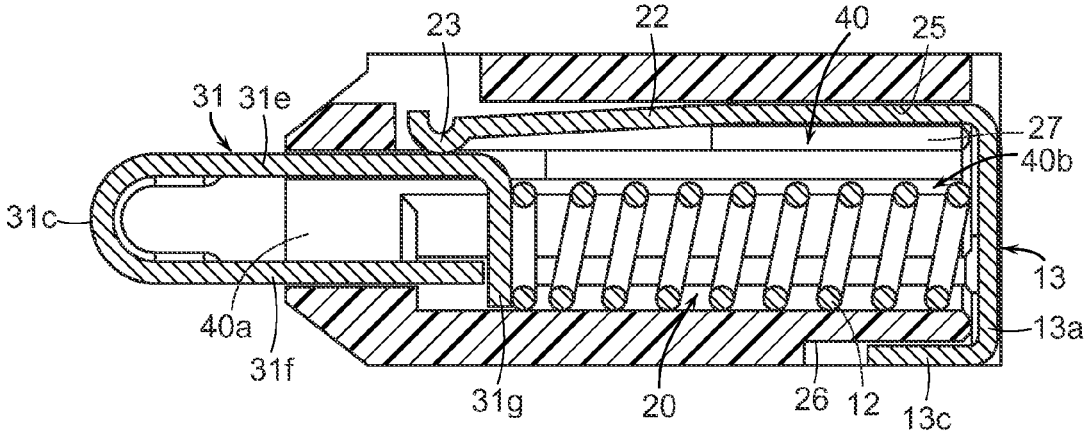
FIG. 8 is a vertical cross-sectional view of the press-contact pogo pin connector in the second embodiment.
Figure 9:
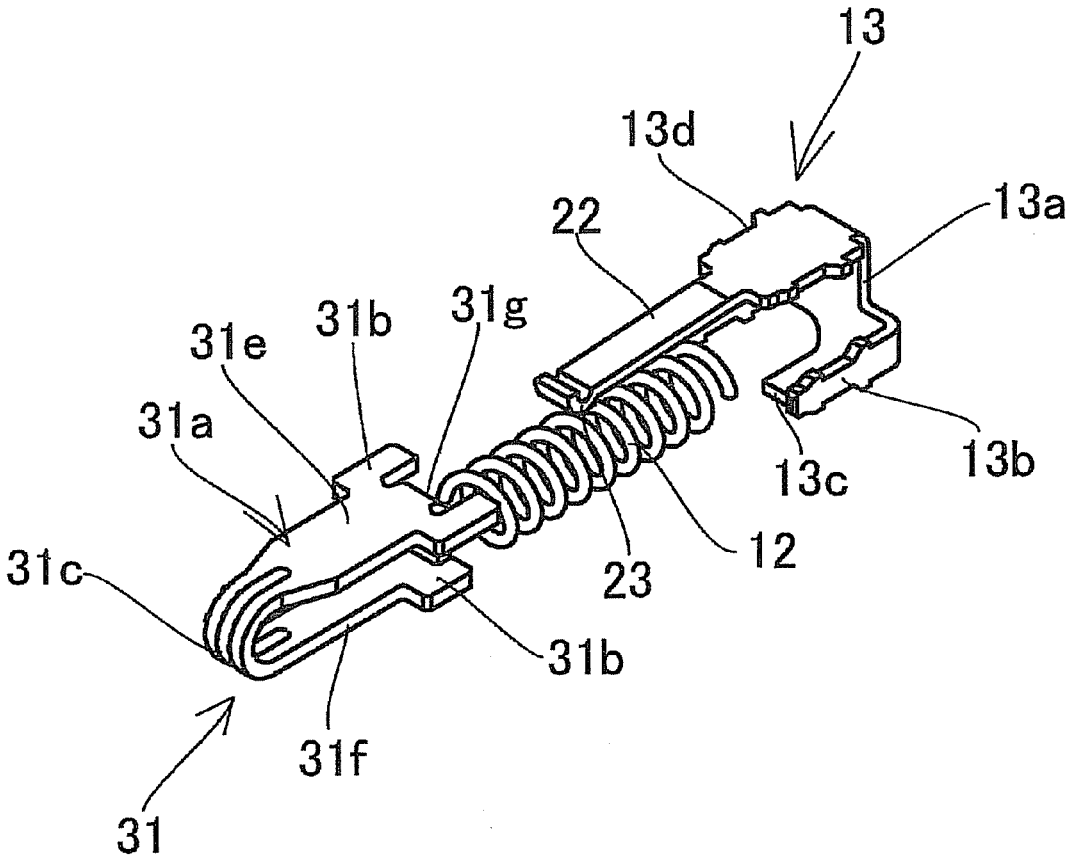
FIG. 9 is an exploded perspective view illustrating a pin, a coil spring, and a contact of the press-contact pogo pin connector in the second embodiment.
Figure 10:
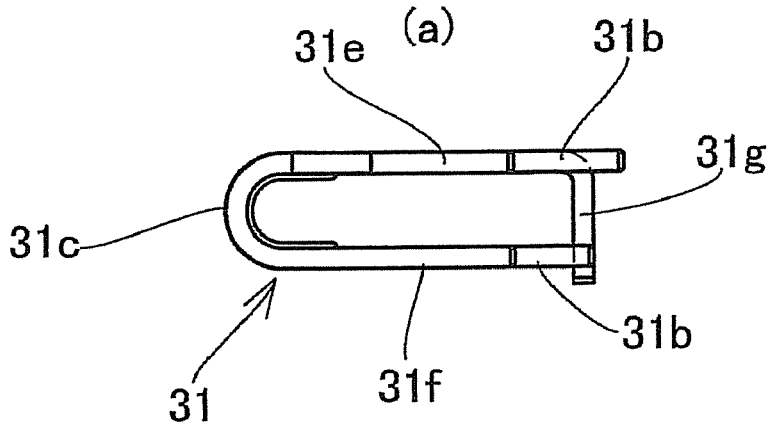
FIG. 10A is a side view of a pin used in the second embodiment.
FIG. 10B is a rear view thereof.
FIG. 10C is a bottom view thereof.
Figure 10:
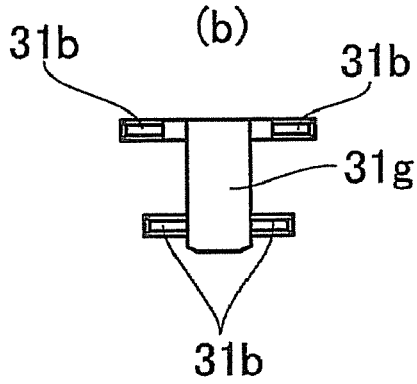
Figure 10:
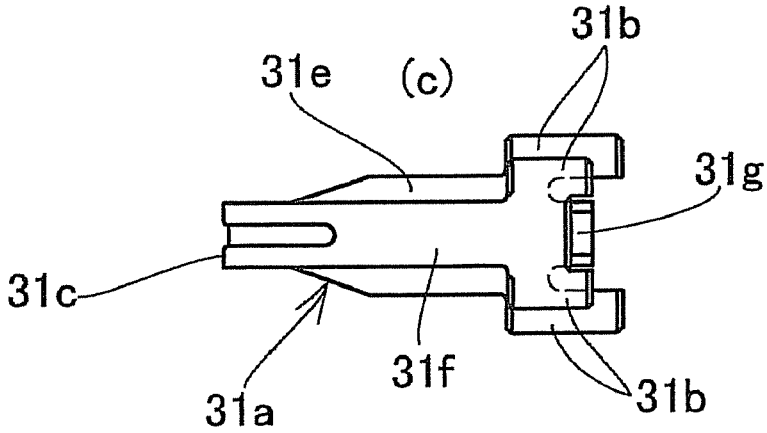
Figure 11:
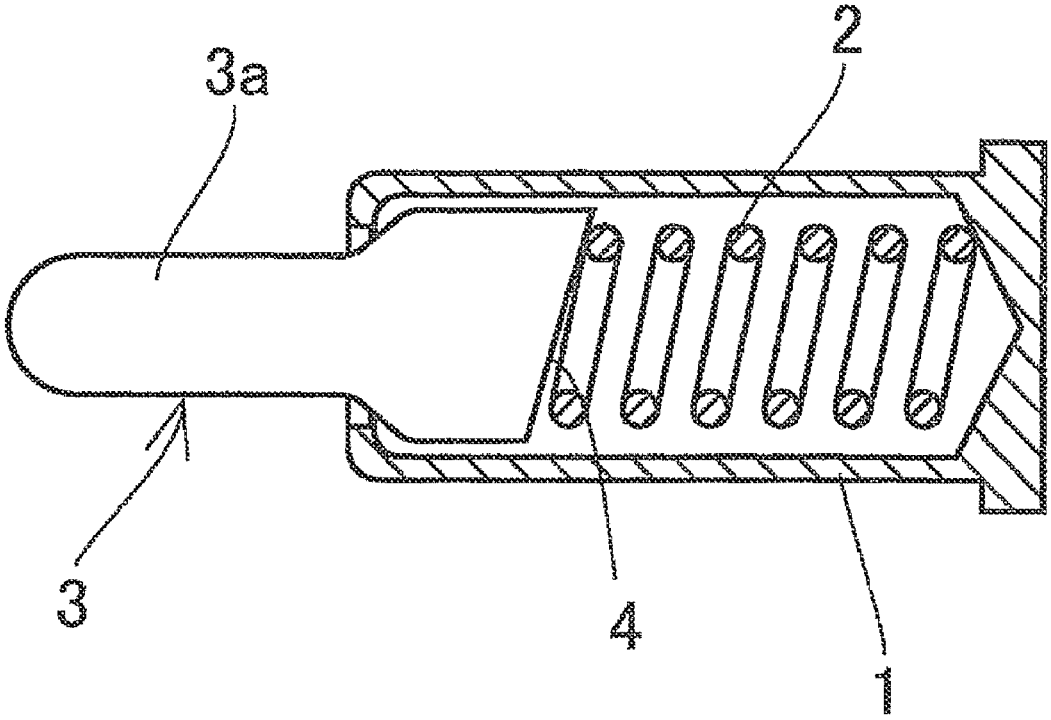
FIG. 11 (Prior Art)
FIG. 11 is a vertical cross-sectional view illustrating an example of a conventional pogo-pin.
Figure 12:
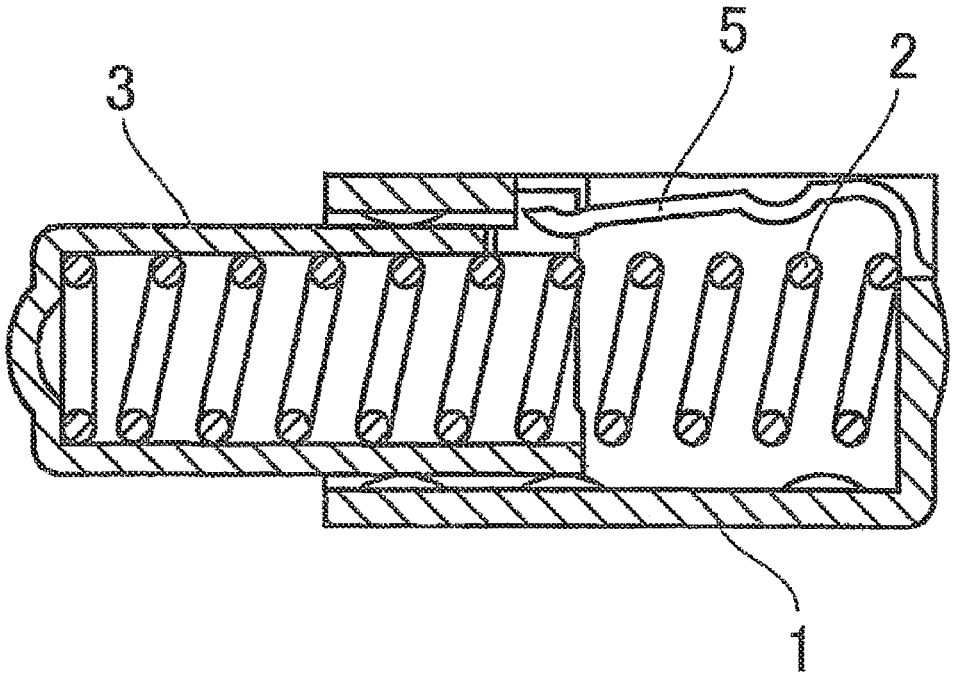
FIG. 12 (Prior Art)
FIG. 12 is a vertical cross-sectional view illustrating another example of a conventional pogo-pin.

As shown in FIG. 4, each pin 11 includes a cylindrical main pin body 11*a* and the flange portion 11*b* protruding from the rear circumferential end thereof, and the other end of the pin body 11*a* is formed as a semi-spherical press-contact surface 11*c*. The flange portion 11*b* protrudes only from the opposite sides at the rear end portion of the main pin body 11*a* and is formed to have upper and lower truncated flat surfaces that are flush with the outer circumferential surface of the main pin body 11*a*.

The main pin body 11*a* is fitted into the front opening 20*a* on the front side of the cylinder hole 20 so as to be axially slidable, and the flange portion 11*b* is fitted into the main portion 20*b* of the cylinder hole 20. In this configuration, the flange portion 11*b* is axially slidable but is not rotatable. The flange portion 11*b* abuts against the peripheral portion of the front opening 20*a* of the cylinder hole 20 on the front side of the housing 10 so that the pin body 11*a* is prevented from falling off.

The rear end of the pin 11 is urged by the coil spring 12 inserted into the cylinder hole 20 so that the front end of the pin 11 protrudes from the cylinder hole 20. The coil spring 12 is prevented from falling off by the contact 13.

The contacts 13 are secured to the rear end surface of the housing 10. As shown in FIGS. 5A to 5C, each contact 13 includes a plate-like main body 13*a* having a cross shape, and the central portion of the main body 13*a* abuts against the rear opening of the cylinder hole 20 to prevent the coil spring 12 from falling off.

Side press-fitting sections 13*b* bent toward the front side of the housing are integrally formed on opposite sides of the main body 13*a*. Also a substrate connection terminal 13*c* bent toward the front side so as to extend along the outer bottom surface of the housing is formed integrally with the lower portion of the main body 13*a*. In addition, an upper press-fitting section 13*d* having a larger width than the side press-fitting sections 13*b* is formed integrally with the upper portion of the main body 13*a* so as to extend toward the front side of the housing 10.

Protruding portions 21 used for press fitting are integrally formed on opposite sides of the upper press-fitting section 13*d*, and a contact spring portion 22 is formed integrally with the end of the upper press-fitting section 13*d* so as to extend in the extending direction of the upper press-fitting section 13*d*. The contact spring portion 22 has an end portion inclined toward the central portion of the main body, i.e., downwardly, and has an arc-shaped contact section 23 formed on the lower end thereof.

Figure 2:
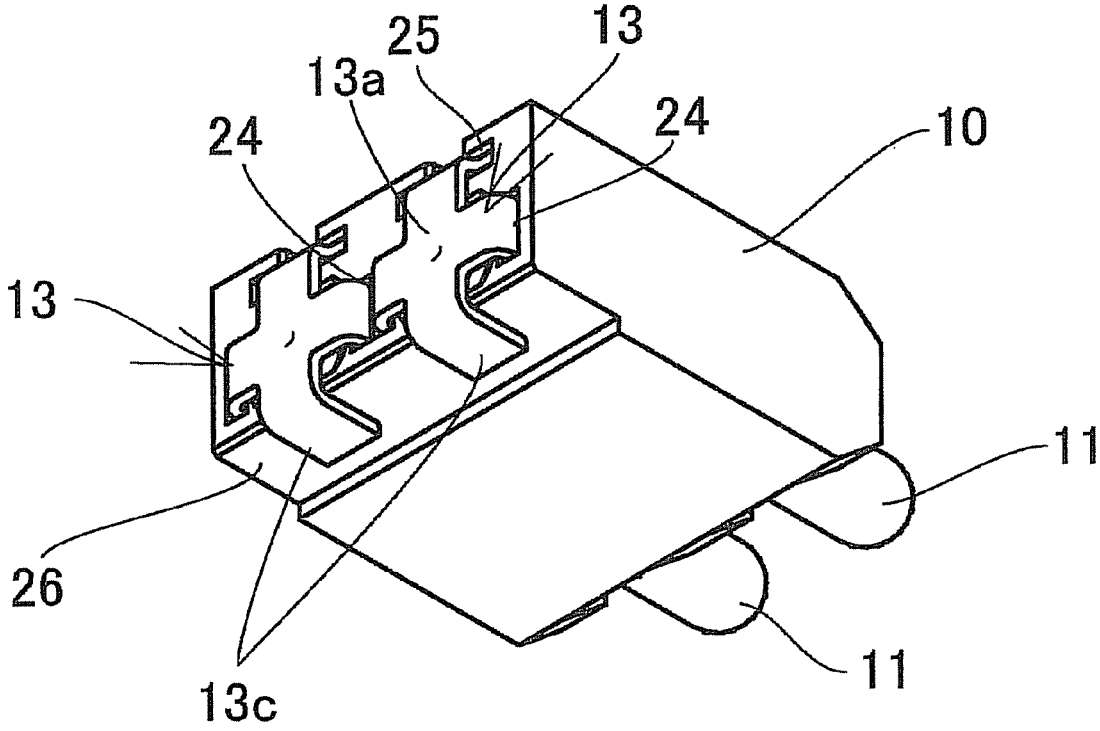
FIG. 2 is a rear perspective view of the press-contact pogo pin connector in the first embodiment.
Figure 3:
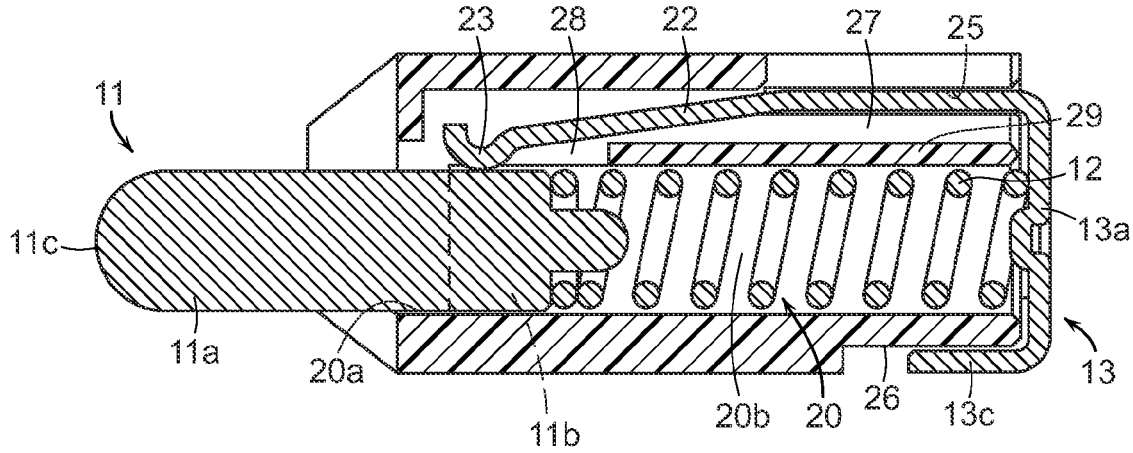
FIG. 3 is a vertical cross-sectional view of the press-contact pogo pin connector in the first embodiment.

As shown in FIG. 2, side press-fitting section-receiving holes 24 are formed on the rear face of the housing 10 so as to be located on the left and right sides of the rear openings of the cylinder hole in the housing, and the left and right side press-fitting sections 13*b* are press-fitted into the side press fitting section-receiving holes 24. Upper press-fitting section-receiving holes 25 are formed on the upper side of the rear openings of the cylinder hole, and the contacts 13 are secured to the housing 10 by inserting the press-fitting sections 13*b* and 13*d* into the receiving holes 24 and 25.

A recessed groove 26 having a depth corresponding to the thickness of the substrate connection terminal 13*c* is formed on the lower surface on the rear end side of the housing 10. The substrate connection terminals 13*c* are inserted into the recessed groove 26, and the contacts 13 are attached so as to be flush with the bottom surface of the housing.

A contact spring portion-receiving hole 27 is formed on the lower central side of each upper press fitting section-receiving hole 25 so as to extend toward the front side of the housing. The contact spring portion 22 is inserted into the hole 27, and a window hole 28 in communication with the cylinder hole 20 is formed in the bottom portion of the hole 27. A partition wall 29 that separates the cylinder hole 20 from the hole 27 is formed on the rear side of the housing so as to extend from the rear end of the window holes 28. The partition wall is not necessarily provided.

The contact spring portions 22 protrude through the window holes 28 into the cylinder holes 20, and the contact sections 23 on the ends of the contact spring portions 22 are in press-contact with the upper surfaces of the pins 11 at all times. When the pins 11 abut against, for example, the connection terminals of a battery and are pushed in, they are slidably moved with the contact sections 23 on the ends of the contact spring portions 22 in contact with the upper surfaces of the pins 11. The contact state is maintained by constant spring pressure at all times, and an instantaneous interruption when external shock is applied is thereby prevented.

In the first embodiment described above, the pins 11 are formed by machining a metal rod-like material using a lathe and a milling cutter. However, the pins 11 may be formed by stamping and bending a metal plate, as in a second embodiment shown in FIGS. 6 to 10. The same parts as those in the above embodiment are denoted by the same reference numerals, and a redundant description is omitted.

As shown in FIGS. 10A to 10C, each pin 31 in the present embodiment includes a main pin body 31*a* formed by bending a strip-like plate material into a U-shape, and a semicircular portion of the U-shaped bent portion serves as a press-contact surface 31*c*. Plate-like parallel flange portions 31*b* are formed on opposite side end edges of each of parallel portions 31*e* and 31*f* of the U-shaped bent portion so as to protrude therefrom. In addition, a spring receiving portion 31*g* is formed at the end of one parallel portion 31*e* so as to be bent perpendicularly toward the other parallel portion 31*f*.

The housing 10 has front openings 40*a* of the cylinder holes on the front end surface thereof, and each front opening 40*a* has a cross-sectional shape that allows a U-shaped main pin body 31*a* to be fitted therein. Main bodies 40*b* of the cylinder holes are formed on the rear side of the housing so as to extend from the front openings 40*a*, and each main body 40*b* has a cross-sectional shape that allows the parallel plate-like flange portion 31*b* fitted therein for axial movement.

The same contacts as those in the above embodiment are used in the present embodiment, and the description thereof is omitted.

In the above embodiments, the contact spring portions that come in contact with the pins are formed integrally with the upper press-fitting sections of the contacts. However, the contact spring portions may be formed integrally with the right or left side press-fitting sections so as to extend therefrom or may be formed integrally with the contacts independently from the press-fitting sections.

In addition, the contact spring portions are configured to be in contact with the pins on the upper side in the housing, i.e., the upper side of the pins. However, the contact spring portions may be configured to be brought into contact with the side surfaces of the pins rotated 90 degrees.

DESCRIPTION OF REFERENCE NUMERALS

10 housing
11 pin
11*b* flange portion
11*a* main pin body
11*c* press-contact surface
12 coil spring
13 contact
13*a* main body
13*b* side press-fitting section
13*c* substrate connection terminal
13*d* upper press-fitting section
20 cylinder hole
20*a* front opening of cylinder hole provided on front side of housing
20*b* main portion of cylinder hole
21 protruding portion
22 contact spring portion
23 contact section
24 side press-fitting section-receiving hole
25 upper press-fitting section-receiving hole
26 recessed groove
27 contact spring portion-receiving hole
28 window hole
29 partition wall
a connection terminal
31 pin
31*a* main pin body
31*b* flange portion
31*c* press-contact surface
31*e*, 31*f* U-shaped parallel portion
31*g* spring receiving portion
40 cylinder hole
40*a* front opening of cylinder hole provided on front side of housing
40*b* main portion of cylinder hole

What is claimed is:

1. A press-contact pogo pin connector comprising:

a molded insulating housing having a cylinder hole with a front opening of the cylinder hole provided on a front side of the housing;

a pin that includes a flange portion at a rear end thereof and is installed inside the cylinder hole;

a coil spring that is installed inside the cylinder hole and urges the pin so that the pin protrudes from the housing; and a contact that includes a substrate connection terminal portion and a contact spring portion and is secured to the housing, the substrate connection terminal portion and the contact spring portion being integrally provided, the contact spring portion extending inside the cylinder hole and being brought into press-contact with the pin at all times, wherein the flange portion of the pin urged by the coil spring abuts against a peripheral portion of the front opening of the cylinder hole so that the pin is prevented from falling off; and wherein the pin includes a main pin body formed by bending a metal strip into a U-shape with two parallel portions and the flange portion that is integrally formed on each side end edge of each of the two parallel portions so as to protrude therefrom.

2. The press-contact pogo pin connector according to claim 1, wherein the main pin body includes a spring receiving portion formed by bending an end portion of one of the two parallel portions that form the U-shape toward the other parallel portion, and an end of the coil spring abuts against the spring receiving portion.

* * * * *